US010390153B2

(12) United States Patent
Meskens et al.

(10) Patent No.: US 10,390,153 B2
(45) Date of Patent: Aug. 20, 2019

(54) SMOOTHING POWER CONSUMPTION OF AN ACTIVE MEDICAL DEVICE

(71) Applicant: Cochlear Limited, Macquarie University, NSW (AU)

(72) Inventors: Werner Meskens, Opwijk (BE); Carl Van Himbeeck, Zottegem (BE)

(73) Assignee: Cochlear Limited, Macquarie University, NSW (AU)

( * ) Notice: Subject to any disclaimer, the term of this patent is extended or adjusted under 35 U.S.C. 154(b) by 317 days.

(21) Appl. No.: 14/886,683

(22) Filed: Oct. 19, 2015

(65) Prior Publication Data

US 2016/0044427 A1 Feb. 11, 2016

Related U.S. Application Data

(63) Continuation of application No. 13/301,946, filed on Nov. 22, 2011, now Pat. No. 9,167,361.

(51) Int. Cl.
*H04R 25/00* (2006.01)

(52) U.S. Cl.
CPC ..... *H04R 25/606* (2013.01); *H04R 25/502* (2013.01); *H04R 2225/33* (2013.01); *H04R 2430/03* (2013.01); *H04R 2460/03* (2013.01); *H04R 2460/13* (2013.01)

(58) Field of Classification Search
USPC ..... 381/97.4
See application file for complete search history.

(56) References Cited

U.S. PATENT DOCUMENTS

| | | | | |
|---|---|---|---|---|
| 6,104,822 | A | 8/2000 | Melanson | |
| 6,631,197 | B1 | 10/2003 | Taenzer | |
| 7,500,746 | B1 * | 3/2009 | Howell | G02C 11/00 351/158 |
| 8,325,964 | B2 * | 12/2012 | Weisman | H04R 1/1083 381/151 |
| 9,167,361 | B2 | 10/2015 | Meskens et al. | |
| 2002/0122563 | A1 * | 9/2002 | Schumaier | H04R 25/606 381/326 |
| 2004/0057586 | A1 * | 3/2004 | Licht | H03G 3/32 381/94.7 |

(Continued)

FOREIGN PATENT DOCUMENTS

| | | |
|---|---|---|
| JP | 06-189395 | 7/1994 |
| WO | 2010/130475 A1 | 11/2010 |

OTHER PUBLICATIONS

International Search Report and Written Opinion for International Application No. PCT/IB2012/056573 dated Apr. 26, 2013.

*Primary Examiner* — Amir H Etesam
(74) *Attorney, Agent, or Firm* — Pilloff Passino & Cosenza, LLP; Martin J. Cosenza

(57) ABSTRACT

An active medical device, including an input receiver configured to receive a frequency-varying input signal, and a functional component that reacts to the input signal and consumes power at a rate dependant on the frequency of portions of the input signal to which the functional component reacts, wherein the active medical device is configured to adjust one or more portions of the input signal corresponding to portions of the input signal where the functional component consumes power at a rate that is greater than that of other portions of the input signal.

26 Claims, 13 Drawing Sheets

(56) References Cited

U.S. PATENT DOCUMENTS

| | | | | |
|---|---|---|---|---|
| 2004/0247148 | A1 | 12/2004 | Pedersen | |
| 2005/0008176 | A1 | 1/2005 | Pedersen | |
| 2006/0215860 | A1* | 9/2006 | Wyrsch ..... | H04R 25/505 381/312 |
| 2007/0032838 | A1 | 2/2007 | Seligman | |
| 2009/0248155 | A1* | 10/2009 | Parker ..... | H04R 25/606 623/10 |
| 2011/0268301 | A1 | 11/2011 | Nielsen et al. | |

* cited by examiner

SMOOTHING POWER CONSUMPTION OF AN ACTIVE MEDICAL DEVICE

The present application is a Continuation application of U.S. patent application Ser. No. 13/301,946, filed Nov. 22, 2011, naming Werner Meskens as an inventor, the entire contents of that application being incorporated herein by reference in its entirety.

BACKGROUND

Field of the Invention

The present invention relates generally to power-consuming medical devices, and more particularly, to smoothing power consumption of such devices.

Related Art

Hearing loss, which may be due to many different causes, is generally of two types: conductive and sensorineural. Sensorineural hearing loss is due to the absence or destruction of the hair cells in the cochlea which transduce sound signals into nerve impulses. Various hearing prostheses are commercially available to provide individuals suffering from sensorineural hearing loss with the ability to perceive sound. For example, cochlear implants use an electrode array implanted in the cochlea to bypass the mechanisms of the ear. More specifically, an electrical stimulus is delivered to the auditory nerve via the electrode array, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses a component positioned in the recipient's ear canal to amplify sound received by the device. This amplified sound reaches the cochlea causing motion of the perilymph and stimulation of the auditory nerve.

In contrast to hearing aids, certain types of hearing prostheses commonly referred to as bone conduction devices, convert a received sound into mechanical vibrations. The vibrations are transferred through the skull to the cochlea causing generation of nerve impulses, which result in the perception of the received sound. Bone conduction devices may be a suitable alternative for individuals who cannot derive sufficient benefit from acoustic hearing aids, cochlear implants, etc.

SUMMARY

According to one aspect of the present invention, there is an active medical device, comprising: an input receiver configured to receive a frequency-varying input signal; and a functional component that reacts to the input signal and consumes power at a rate dependant on the frequency of the input signal to which the functional component reacts, wherein the device is configured to adjust one or more portions of the input signal where the functional component consumes power at a rate that is greater than that of other portions of the input signal.

According to another aspect of the invention, there is an active medical device comprising: a functional component that has a parameter-dependent power consumption profile; and a power-smoothing circuit configured to determine an intensity level of a frequency-varying input signal, and to adjust, based on the intensity level, a parameter referenced by the functional component upon which the parameter-dependent power consumption profile depends so as to selectively reduce power consumption of the functional component, wherein the functional component is operably responsive to the adjusted parameter.

According to another aspect of the invention, there is a method of reducing power consumption of an active medical device including a functional component reactive to an input signal, comprising receiving the input signal, filtering the input signal to attenuate frequencies for which the functional component consumes power at a rate that is greater than that of other frequencies, and providing the filtered input signal to the functional component such that the functional component reacts to the input signal.

According to another aspect of the invention, there is a method of operating a hearing prosthesis, comprising receiving an acoustic signal having intensity level components, generating a signal, representative of the received acoustic signal, having corresponding intensity level components, evaluating the intensity level components of the input signal, and adjusting an operating parameter of the hearing prosthesis based on the intensity level, and evoking a hearing percept based on the received acoustic signal with the hearing prosthesis at the adjusted operating parameter so as to evoke the hearing percept utilizing a reduced amount of power as compared to evoking a hearing percept based on the received acoustic signal with the hearing prosthesis without adjustment of the operating parameter.

BRIEF DESCRIPTION OF THE DRAWINGS

Illustrative embodiments of the present invention are described herein with reference to the accompanying drawings, in which.

DETAILED DESCRIPTION

Aspects of the present invention are generally directed to reducing a rate of power consumption of a medical device, such as a bone conduction device. In one exemplary embodiment, the device consumes power at a rate that is dependant on the frequency of a frequency-varying input signal to which a functional component of the device reacts. In another exemplary embodiment, the device consumes power at a higher rate than may be necessary to attain sufficient efficacious performance. Exemplary embodiments described herein are presented in connection with a specific type of active medical device, namely a hearing prosthesis that processes received audio signals, and more specifically, a bone conduction device that mechanically stimulates the recipient to cause a hearing percept. Some embodiments of the present invention may be implemented in other hearing prostheses as well as other medical devices that react to or otherwise process frequency-varying input signals, as will now be briefly described.

Broadly speaking, active medical devices (AMDs) consume power. Some exemplary embodiments detailed herein are directed to strategies to reduce power consumption of a given AMD by adopting techniques to operate the AMD in a more energy-efficient manner based on specific characteristics of the given AMD. In some exemplary embodiments, certain frequencies within an input signal upon which operation of the AMD is based are identified as contributing more to the AMD's power consumption than other frequencies. In such embodiments, the input signal is filtered to selectively reduce (including eliminate) at least one of the more power intensive frequency components. In some exemplary embodiments, certain features of the input signal upon which operation of the AMD is based may indicate conditions for which a less than full operational capability can be sufficient in order to obtain sufficiently efficacious performance of the AMD. In such embodiments, there may be selective adjustment of one or more parameters of the AMD to temporarily adopt less than full operational capability, thereby reducing power consumption, while still providing sufficiently effective performance. Hereinafter, this is sometimes referred to as leveling.

Additional details of the above embodiments and other embodiments will be described in greater detail below. Prior to this, an exemplary medical device with which embodiments disclosed herein and variations thereof may be utilized will be briefly discussed.

Figure 1:
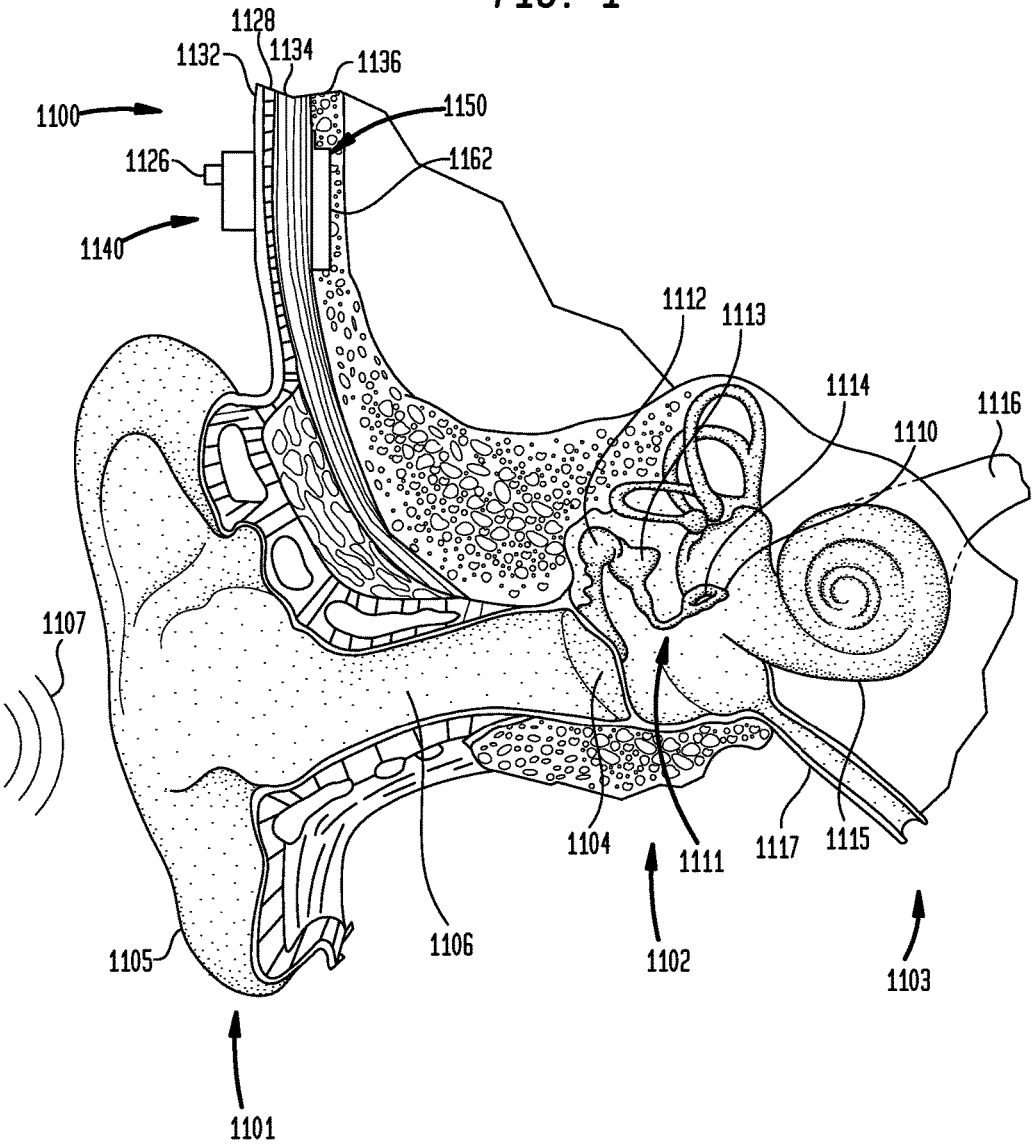
FIG. 1 is a perspective view of a transcutaneous bone conduction device in which embodiments of the present invention may be implemented.

FIG. 1 is a perspective view of a transcutaneous bone conduction device 1100 in which embodiments of the present invention may be implemented. As shown, the recipient has an outer ear 1101, a middle ear 1102 and an inner ear 1103. Elements of outer ear 1101, middle ear 1102 and inner ear 1103 are described below, followed by a description of bone conduction device 1100.

In a fully functional human hearing anatomy, outer ear 1101 comprises an auricle 1105 and an ear canal 1106. A sound wave or acoustic pressure 1107 is collected by auricle 1105 and channeled into and through ear canal 1106. Disposed across the distal end of ear canal 1106 is a tympanic membrane 1104 which vibrates in response to acoustic wave 1107. This vibration is coupled to oval window or fenestra ovalis 1110 through three bones of middle ear 1102, collectively referred to as the ossicles 1111 and comprising the malleus 1112, the incus 1113 and the stapes 1114. The ossicles 1111 of middle ear 1102 serve to filter and amplify acoustic wave 1107, causing oval window 1110 to vibrate. Such vibration sets up waves of fluid motion within cochlea 1139. Such fluid motion, in turn, activates hair cells (not shown) that line the inside of cochlea 1139. Activation of the hair cells causes appropriate nerve impulses to be transferred through the spiral ganglion cells and auditory nerve 1116 to the brain (not shown), where they are perceived as sound.

FIG. 1 also illustrates the positioning of bone conduction device 1100 relative to outer ear 1101, middle ear 1102 and inner ear 1103 of a recipient of device 1100. As shown, bone conduction device 1100 is positioned behind outer ear 1101 of the recipient. It is noted that in other embodiments, the bone conduction device 1100 may be located at other positions on the skull. Bone conduction device 1100 comprises an external component 1140 and implantable component 1150. External component 1150 is located beneath skin 1132, and partially or fully below adipose tissue 1128 and/or muscle tissue 1128. The bone conduction device 1100 includes a sound input element 1126 to receive sound signals. Sound input element 1126 may comprise, for example, a microphone, telecoil, etc. In an exemplary embodiment, sound input element 1126 may be located, for example, on or in bone conduction device 1100, on a cable or tube extending from bone conduction device 1100, etc. Alternatively, sound input element 1126 may be subcutaneously implanted in the recipient, or positioned in the recipient's ear. Sound input element 1126 may also be a component that receives an electronic signal indicative of sound, such as, for example, from an external audio device. For example, sound input element 1126 may receive a sound signal in the form of an electrical signal from an MP3 player electronically connected to sound input element 1126.

Bone conduction device 1100 comprises a sound processor (not shown), an actuator (also not shown) and/or various other operational components. In operation, sound input device 1126 converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with embodiments of the present invention, a fixation system 1162 may be used to secure implantable component 1150 to skull 1136. As described below, fixation system 1162 may include an implant at least partially embedded in the skull 1136.

In one arrangement of FIG. 1, bone conduction device 1100 is an active transcutaneous bone conduction device where at least one active component, such as the actuator, is implanted beneath the recipient's skin 1132 and is thus part of the implantable component 1150. As described below, in such an arrangement, external component 1140 may comprise a sound processor and transmitter, while implantable component 1150 may comprise a signal receiver and/or various other electronic circuits/devices.

In another arrangement of FIG. 1, bone conduction device 1100 is a passive transcutaneous bone conduction device. That is, no active components, such as the actuator, are implanted beneath the recipient's skin 1132. In such an arrangement, the active actuator is located in external component 1140, and implantable component 1150 includes a movable component as will be discussed in greater detail below. The movable component of the implantable component 1150 vibrates in response to vibration transmitted through the skin, mechanically and/or via a magnetic field, that are generated by an external magnetic plate.

In a variation of the arrangement of FIG. 1, bone conduction device 1100 is a percutaneous bone conduction device in that the active component is located in external component 1140. External component 1140 is connected to the skull via an abutment that penetrates the skin of the recipient and a bone screw (or bone fixture) screwed into the skull 136 such that vibrations generated by the external component 1140 are communicated to the skull 136.

Figure 1A:
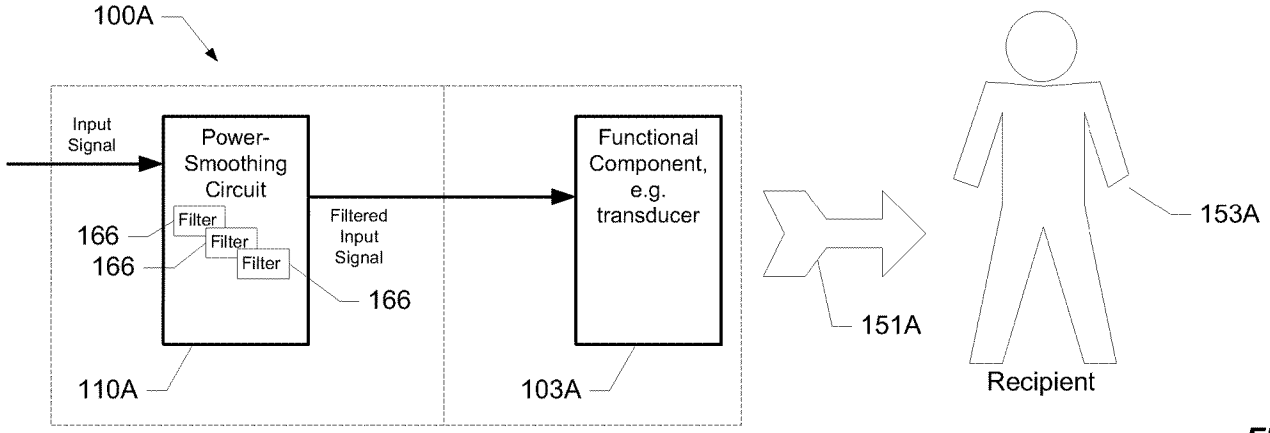
FIG. 1A illustrates an example of an active medical device according to an embodiment of the present invention.

FIG. 1A illustrates an example of an active medical device (AMD) 100A, according to an embodiment of the present invention. The AMD 100A may be a percutaneous bone conduction device in some exemplary embodiments, or a transcutaneous bone conduction device (active or passive) in other embodiments. The AMD 100A includes a functional component 103A (e.g., a transducer) and a power-smoothing circuit 110A. The functional component 103A has a frequency-dependent power consumption profile. This profile may be known, such as thorough empirical and/or analytical experimentation, for example, during a design stage and/or a manufacturing stage (e.g., as part of a quality-assurance phase thereof). The power-smoothing circuit 110A receives an input signal having time-varying frequency components (e.g., an audio signal in a context of a hearing prosthesis) and filters the input signal so as to obtain the power consumption reduction. In an exemplary embodiment, the input signal is filtered according to the power consumption profile so as to selectively reduce one or more power intensive ('power hungry') frequency components in the input signal. In an exemplary embodiment, the reduced frequency components may be one or more frequency components for which consumption of power by the functional component 103A has a relatively greater dependence. Reducing the frequency component(s) may have utility in that it may correspondingly reduce an amount of power consumed by the functional component. In an exemplary embodiment, the filtering characteristics of the AMD are identified at the design stage, while in other embodiments the filtering characteristics of the AMD are identified at the fabrication stage or after the fabrication stage.

Still with reference to FIG. 1A, the functional component 103A is disposed in relation to a recipient 153A of the AMD 100A, and provides stimulation to the recipient 153A as indicated by arrow 151A. For example, in an exemplary embodiment where the AMD is a hearing prosthesis, (e.g., a hearing prosthesis that directly stimulates cochlea 1139 mechanically), the transducer may be implanted in the recipient. In an embodiment where the AMD is a passive transcutaneous bone conduction device, the transducer may be held against the outer skin of the recipient adjacent an implanted component of the device.

An exemplary embodiment of the present invention includes a functional component having a frequency-dependent power consumption profile that includes one or more resonance peaks. In an exemplary embodiment, frequency component reduction is accomplished by filtering. Such filtering may be accomplished via the use of, for example, notch filtering. In an exemplary embodiment utilizing notch filtering, respective notch center frequencies correspond to respective resonance peaks. Still further by example, in some embodiments where the profile might indicate that power consumption increases with frequency, low pass filtering is utilized.

Some embodiments may be practiced utilizing filtering that varies based upon, for example, an energy level available from a battery (or other power storage device). (Such embodiments may be practiced in combination with other techniques detailed herein.) In some such exemplary embodiments, as the available energy level from the battery decreases, filtering is performed to a greater degree than at the higher energy level. Such filtering may be accomplished by, for example, utilizing notches that can be progressively deepened as the available energy level decreases.

In another exemplary embodiment, the notch filtering can be enhanced relative to a desired frequency band. Some such embodiments rely on the phenomenon that the location of a resonance peak in the frequency spectrum can impact the likelihood (e.g., make it relatively less likely or more likely) that the input signal will contain a significant intensity (e.g., power consuming intensity) at that frequency. By way of illustrative example, a band of frequencies may have significant intensities with regard to human speech. An exemplary embodiment may address this phenomenon by utilizing a notch filter in a manner such that if a resonance peak in the profile overlaps a significant frequency band, the corresponding notch in the filter is made deeper. This may be done because, in some embodiments, some input signals are more likely than not to have a significant intensity at the resonance frequency.

Figure 1B:
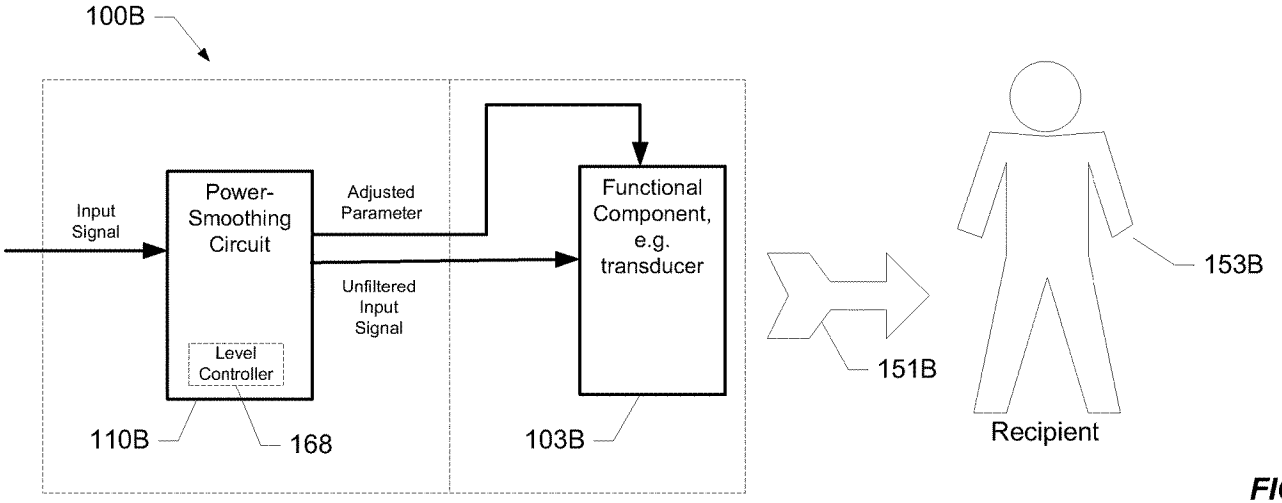
FIG. 1B illustrates another example of an active medical device according to an embodiment of the present invention.

FIG. 1B illustrates another example of an AMD 100B, according to an embodiment of the present invention, which utilizes leveling to reduce power consumption. AMD 100B includes a functional component 103B and a power-smoothing circuit 110B. Functional component 103B is disposed relative to a recipient of AMD 100B, as indicated by arrow 151B. Functional component 103B may have a substantially time-invariant parameter and a parameter-dependent power consumption profile. Power-smoothing circuit 110B is configured to receive an input signal having time-varying frequency components, determine an intensity level of the input signal, and adjust the parameter based upon the intensity level so as to selectively reduce power consumption, as will now be further described.

In an exemplary embodiment where the AMD 100B is a hearing prosthesis (e.g., of a type that has an internal module and an external module that communicate transcutaneously, such as a cochlear implant), the transducer is the functional component and the parameter is a modulation parameter (e.g., a pulse-width control signal "PW_CTRL"), which affects the transcutaneous coupling between the external and internal modules. The intensity of the input signal (in this exemplary embodiment, an audio signal), can be monitored so as to recognize relatively quieter conditions and/or relatively louder conditions and/or recognize a change from one such condition to another such condition. With respect to an embodiment that recognizes quieter conditions, once quieter conditions are so recognized, the value of PW_CTRL may be decreased so as to reduce a duty cycle of the wireless transmission system, and thereby reduce power consumption.

Figure 1C:
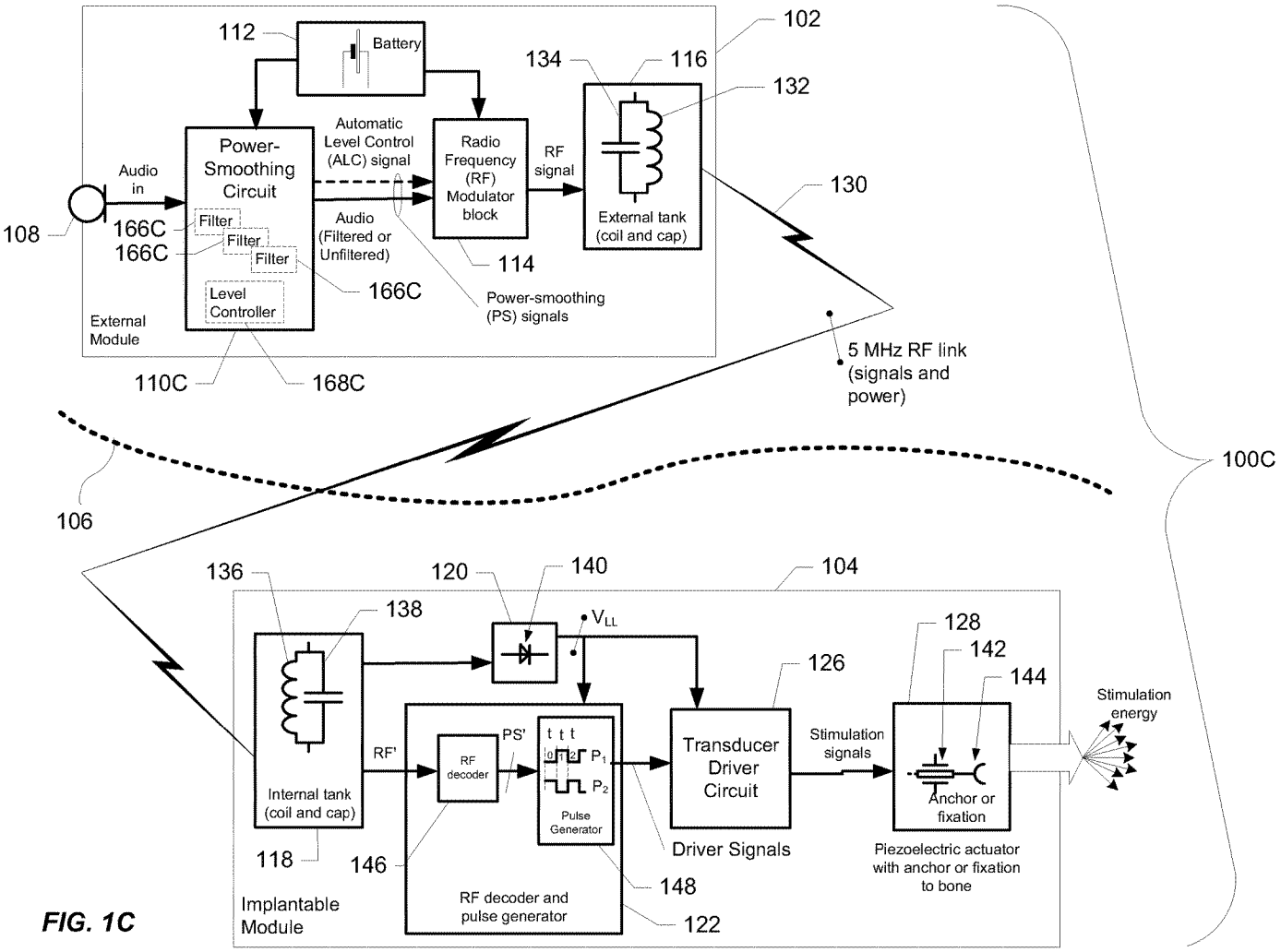
FIG. 1C is a block diagram of a bone conduction device according to an embodiment of the present invention.

FIG. 1C is a functional diagram of a bone conduction device 100C having a power-smoothing circuit 100C corresponding to the power-smoothing circuits of the embodiments of FIG. 1A or 1B or a combination thereof, as just detailed. Accordingly, the bone conduction device 100C is a selective power-consumption-reducing active medical device (again, "AMD"). The AMD 100C includes an external component in the form of an external module 102 and an implantable component in the form of an implantable module 104. The implantable module 104 is illustrated as having been implanted within a body of a person suffering from hearing loss, as denoted by a layer of skin 106 separating the implantable module 104 from the external module 102. Communication between the external module 102 and the implantable module 104 takes place transcutaneously via a radio frequency (RF) link 130 using, by way of example, a 5 MHz carrier frequency. Power and/or control signals can be transferred via the RF link 130 from the external module 102 to the implantable module 104.

The external module 102 of FIG. 1C includes, by way of example, an audio transducer 108 (e.g., a microphone), a power-smoothing circuit 110C that itself may include a digital signal processor (DSP), a power supply 112 (e.g., a battery), a radio frequency modulator 114, and an external RF tank circuit 116. The audio transducer 108 is operable to generate an audio signal representing acoustic content of a sound impinging upon the recipient. The external RF tank circuit 116 includes a coil 132 and a capacitor 134. The RF modulator block 114 is configured to use, for example, digital modulation (e.g., On Off Keying (OOK) modulation) and to generate an RF signal. In FIG. 1C, the external module 102 is depicted has having one housing (represented by the solid line surrounding the components, but it is noted that the components of the module maybe divided such that respective components are located in two or more housings.

As will be discussed in more detail below, the power smoothing circuit 110C includes one or more filters 166C, and/or a level controller 168C. Because of the optional presence/absence of these components, these components are represented in dashed lines.

In embodiments having one or more filters 166C, the filter(s) provide a filtered audio signal(s) to the RF modulator block 114. If these filters are not present in a given embodiment, the power smoothing circuit 110C may transfer an unfiltered audio signal(s) to the RF modulator 114. In embodiments having the level controller 168C, the level controller 168C provides an automatic level control (ALC) signal to the RF modulator 114.

Figure 1F:
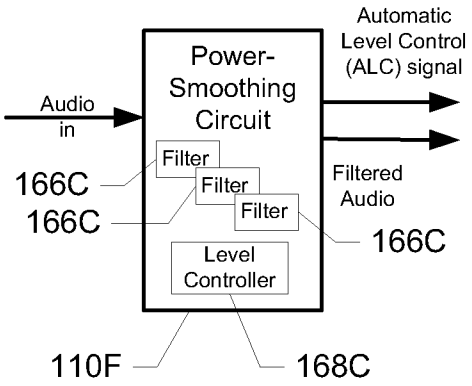
FIG. 1F illustrates a power smoothing circuit that includes the one or more filters and the level controller according to an embodiment of the present invention.
Figure 1E:
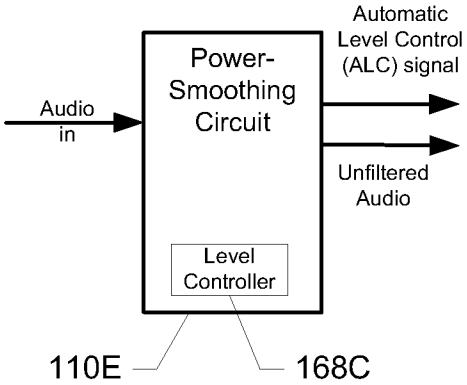
FIG. 1E illustrates a power smoothing circuit that includes a level controller according to an exemplary embodiment of the present invention.
Figure 1D:
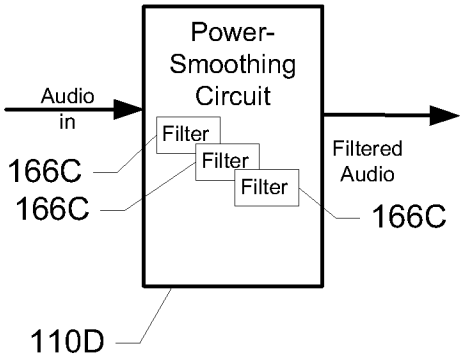
FIG. 1D illustrates a power smoothing circuit that includes one or more filters according to an embodiment of the present invention.

FIG. 1D illustrates a power smoothing circuit 110D according to an embodiment of the present invention that includes one or more filters 166C but does not include the level controller 168C. Circuit 110D may be used as circuit 110C in external module 102. As no level controller is included, the power smoothing circuit 110B only outputs the filtered audio signal(s) without a control signal.

FIG. 1E illustrates a power smoothing circuit 110C according to an embodiment of the present invention that includes the level controller 168C but does not include one or more filters 166C. Circuit 110E may be used as circuit 110C in external module 102. As no filter is included, the power smoothing circuit is 110E outputs the ALC signal and the unfiltered audio signal(s).

FIG. 1F illustrates a power smoothing circuit 110F according to an embodiment of the present invention that includes one or more filters 166C and the level controller 168C, and accordingly outputs the filtered audio signal(s) and the ALC signal. Circuit 110F may be used as circuit 110C in external module 102.

Referring back to FIG. 1C, the implantable module 104 of FIG. 1C includes an internal RF tank circuit 118, a power rectification circuit 120 that includes a rectifier 140, an RF decoder and pulse generator 122, a transducer driver circuit 126 (e.g., implemented via an application-specific integrated circuit (ASIC)), and an electromechanical stimulation transducer 128 that includes a piezoelectric actuator 142. The rectification circuit 140 extracts power from the RF link 130, and supplies the extracted power as a voltage $V_{LL}$ to the RF decoder and pulse generator 122 and the transducer driver circuit 126. The internal RF tank circuit 118 includes a coil 136 and a capacitor 138 connected in parallel. The transducer driver circuit 126 is, for example, a Class-D amplifier. The piezoelectric device actuator 142 is illustrated as including an anchor 144 or other fixation device, thereby permitting the piezoelectric device actuator 142 to be placed into vibrational communication with bone of the recipient (e.g., the skull). The stimulation transducer can be regarded as a capacitive load to the driver 126.

The RF decoder and pulse generator 122 of FIG. 1C is configured to use a demodulation scheme that corresponds to the modulation scheme of the RF modulator block 114. Accordingly, the RF decoder and pulse generator 122 is configured to use, for example, digital demodulation (e.g., OOK demodulation). In the exemplary embodiment of FIG. 1C, the RF decoder and pulse generator 122 has been illustrated as including two functional blocks, namely an RF decoder 146 (e.g., an OOK decoder) and a pulse generator 148. A simple OOK decoder includes, for example, a diode loaded to an RC parallel circuit.

The pulse generator 148 can be, for example, a pulse width modulator, pulse density modulator or a sigma-delta modulator. The pulse generator 148 produces two bit streams, $P_1$ and $P_2$, with each bit stream being 1-bit wide. In an exemplary embodiment, the bit streams $P_1$ and $P_2$ are non-overlapping. The transducer driver circuit 126, for example, can be driven directly with the two bit streams, $P_1$ and $P_2$.

Figure 2:
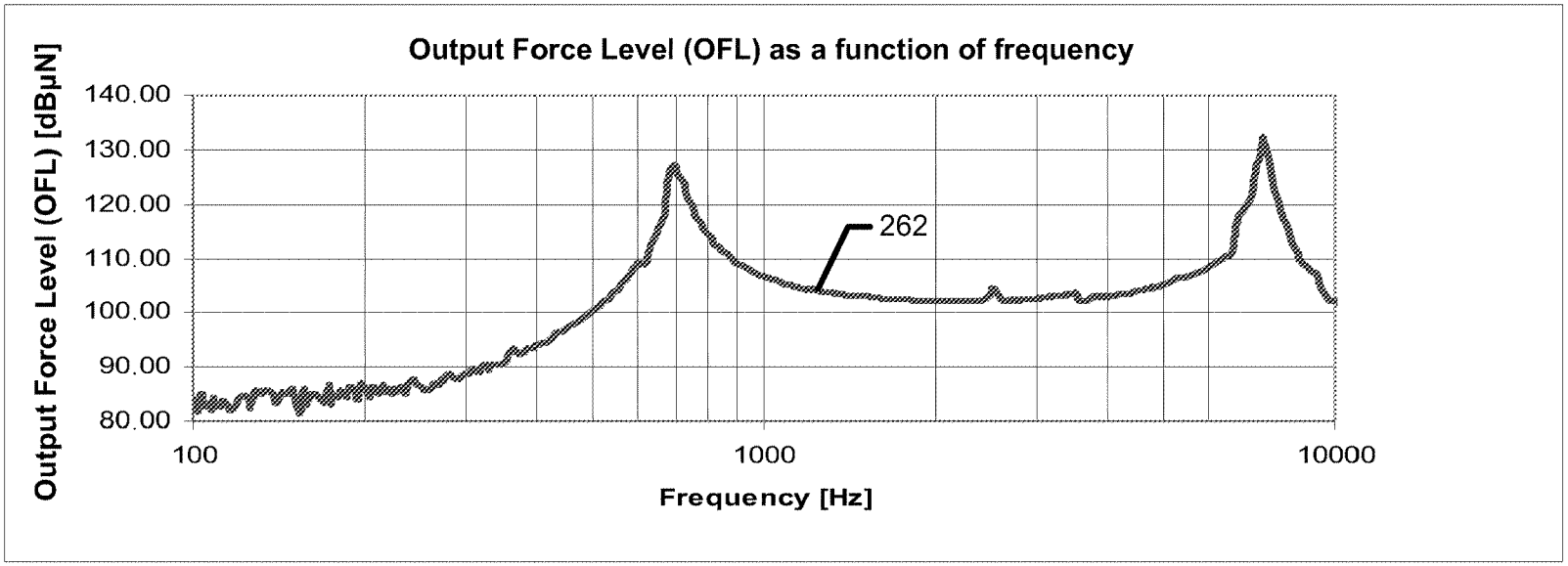
FIG. 2 is a plot of a frequency response of an exemplary stimulation transducer illustrated in FIG. 1C.
Figure 3:
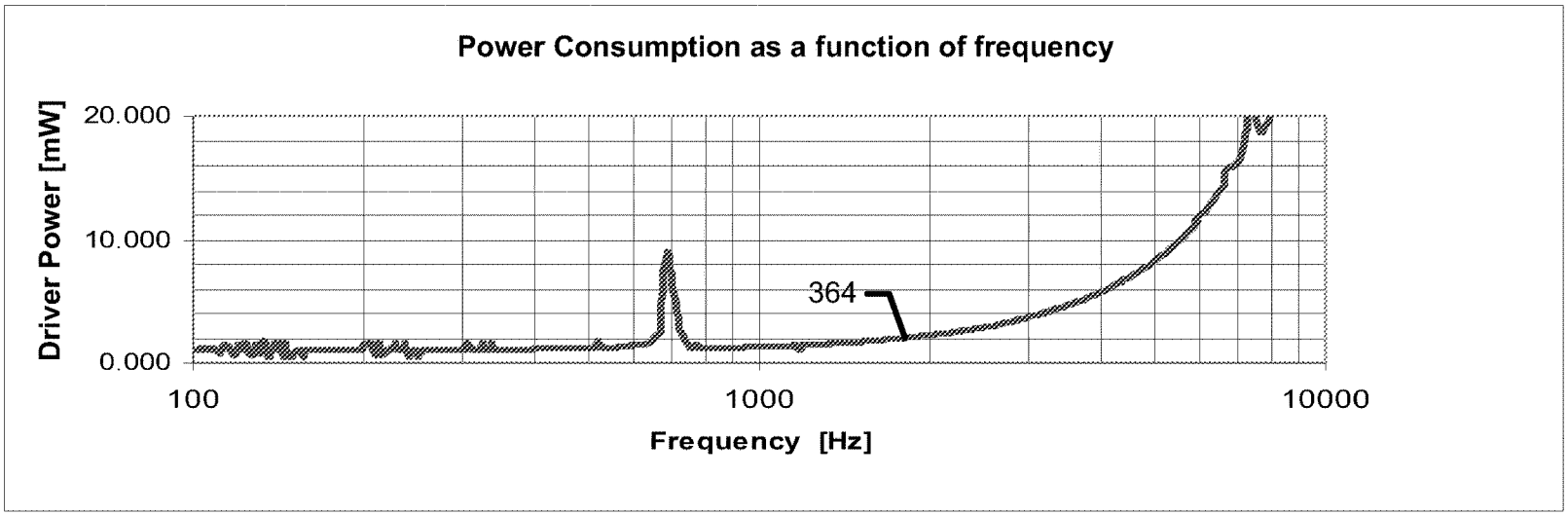
FIG. 3 is a plot of power consumed by the exemplary stimulation transducer having the frequency response illustrated in FIG. 2.

FIG. 2 depicts a graph including an exemplary plot 262 of the magnitude of a frequency response of the exemplary implantable module 104 of the embodiment of FIG. 1C described above. The plot 262 reflects use of an exemplary stimulation transducer 128 corresponding to, by way of example, a 2.2 uF twin mass piezoelectric actuator that has been connected to and hence driven by transducer driver circuit 126. The plot 262 results from the transducer driver circuit 126 being provided with a voltage $V_{LL}$ of 3 volts. The x-axis of the graph of FIG. 3 represents frequency in units of Hertz (Hz) of the signal. The y-axis of the graph of FIG. 3 represents an output force level (OFL) generated by the stimulation transducer 128, and is denominated in units of dbμN, where dBμN=20*log (x/1 μN), and N is a Newton. In other words, a value of OFL for the stimulation transducer 128 at a given frequency describes a force that the stimulation transducer 128 will exert upon the bone into which it is implanted. In the plot 262, resonance peaks can be observed at about 700 Hz and about 1750 Hz.

FIG. 3 depicts a graph including an exemplary plot 364 of power consumed by the exemplary stimulation transducer 128 of the implantable module to which the frequency response plotted in FIG. 3 corresponds. In the plot 364, the x-axis represents signal frequency in units of Hertz (Hz), and the y-axis represents power consumed by the stimulation transducer 128 in units of milliwatts (mW). In correspondence to resonance peaks exhibited by the plot 262, power consumption peaks can be observed in the plot 364 at about 700 Hz and about 1750 Hz. It is these power consumption peaks that are smoothed by the power-smoothing circuits utilizing filtering detailed herein in order to reduce the maximum instantaneous power consumption of the stimulation transducer 128. Specifically, some embodiments include techniques usable with such embodiments that result in smoothing the power consumption of the stimulation transducer 128 (and thereby that of the implantable module 104). Such techniques may be considered as corresponding to techniques for reducing the maximum instantaneous power consumed by the stimulation transducer 128. As will be understood from the embodiments of FIGS. 1A, 1D and 1F, some such exemplary technique may be used in bone conduction device 100C. Specifically, in embodiments of the bone conduction device 100C that utilize the power-smoothing circuit 110D of FIG. 1D and 110F of FIG. 1F, such embodiments selectively filter the audio signal outputted from the audio transducer 108 so as to reduce the content of the signal at or about the frequencies corresponding to the resonance frequencies of the implantable module 104.

With respect to bone conduction device 110C, rather than provide a notch in the notch filter corresponding to the resonance peak observed at about 1750 Hz, a low pass filter (LPF) instead can be provided that is configured with a pass band below the approximately 1750 Hz resonance peak. Accordingly, another of the one or more active filters 166 of the DSP (again, an example implementation of the power smoothing circuit 110A) is a low pass filter tuned to have a pass band below the approximately 1750 Hz resonance peak.

As noted above, the power smoothing circuit 110C of bone conduction device 100C can be implemented as a DSP such that the one or more filters 166 can be active filters. One of the active filters 166 can be configured as a notch filter with at least one notch corresponding to at least one of the one or more peaks in the frequency response (e.g., the peaks in plot 262), of the stimulation transducer 128 and/or implantable module 104. More particularly, the magnitude of a given notch in the notch filter, in some embodiments, is inversely proportional to the magnitude of a corresponding resonance peaks in the frequency response (e.g., the plot 262). For example, a notch filter tuned to compensate for the peaks of the plot 262 of the frequency response would have at least a first notch centered at about 700 Hz and corresponding in magnitude inversely proportionally thereto, and/or may also have a second notch centered at about 1750 Hz.

Some embodiments utilizing leveling, that is, the selective adjustment of one or more parameters of the bone conduction device 100C to temporarily adopt less than full operational capability, thereby reducing power consumption, while still providing effective performance, will now be described. As will be understood from the embodiments of FIGS. 1B, 1C, 1E and 1F, some variations of bone conduction device 100C utilize a power leveling controller. Specifically, in embodiments of the bone conduction device 100C that utilize the power-smoothing circuit 110E of FIG. 1E and 110F of FIG. 1F, such embodiments automatically provide level control. Specifically, the level controller 168 of the power-smoothing circuits 110E and 110F recognizes a loudness level corresponding to relatively quiet acoustical conditions of the recipient's environment (as extrapolated from the output of transducer 108) and correspondingly adjusts one or more operating parameters of the bone conduction device 100C based upon the loudness level so as to selectively reduce a level of power consumption by the transducer 128 of the implantable module 104. Here, the one or more operating parameters of the bone conduction device 110C are substantially time invariant and so do not directly represent or are otherwise directly correlated to acoustic content of sound impinging upon the recipient. Such operating parameters include, for example, a voltage $V_{kk}$ used internally by the RF modulator 114, a digital modulation parameter in the circumstance that the RF modulator 114 uses digital modulation, etc.

More specifically, some exemplary embodiments of the level controller 168 are configured to recognize relatively quiet acoustical conditions and then adjust (by selectively reducing) a pulse width of the OOK scheme used by the RF modulator 114. This results in the level of the voltage $V_{LL}$ provided to the transducer driver circuit 126 by the rectification circuit 120 being selectively reduced, resulting in power smoothing.

More particularly, the level controller 168 is configured to determine a loudness level based upon the audio signal from the audio transducer 108. The level controller 168 can be configured with a first mapping, namely a loudness:pulse width PW mapping (e.g., in the form of a look-up table (LUT), an executable block of instructions, etc.) between loudness levels and values for the pulse width PW. The level controller 168 is further operable to index the loudness level into the first mapping and retrieve therefrom a corresponding value of the pulse width PW, and supply the same to the RF modulator 114.

Before discussing further specific features of the exemplary leveling embodiments, details pertaining to the underlying features of the bone conduction device 110C useful in conveying understanding of these specific features will now be discussed. Specifically, an exemplary circuit schematic of a transducer drive circuit will be described, followed by a discussion on conceptual principles underlying the use of leveling to smooth power consumption.

Figure 4:
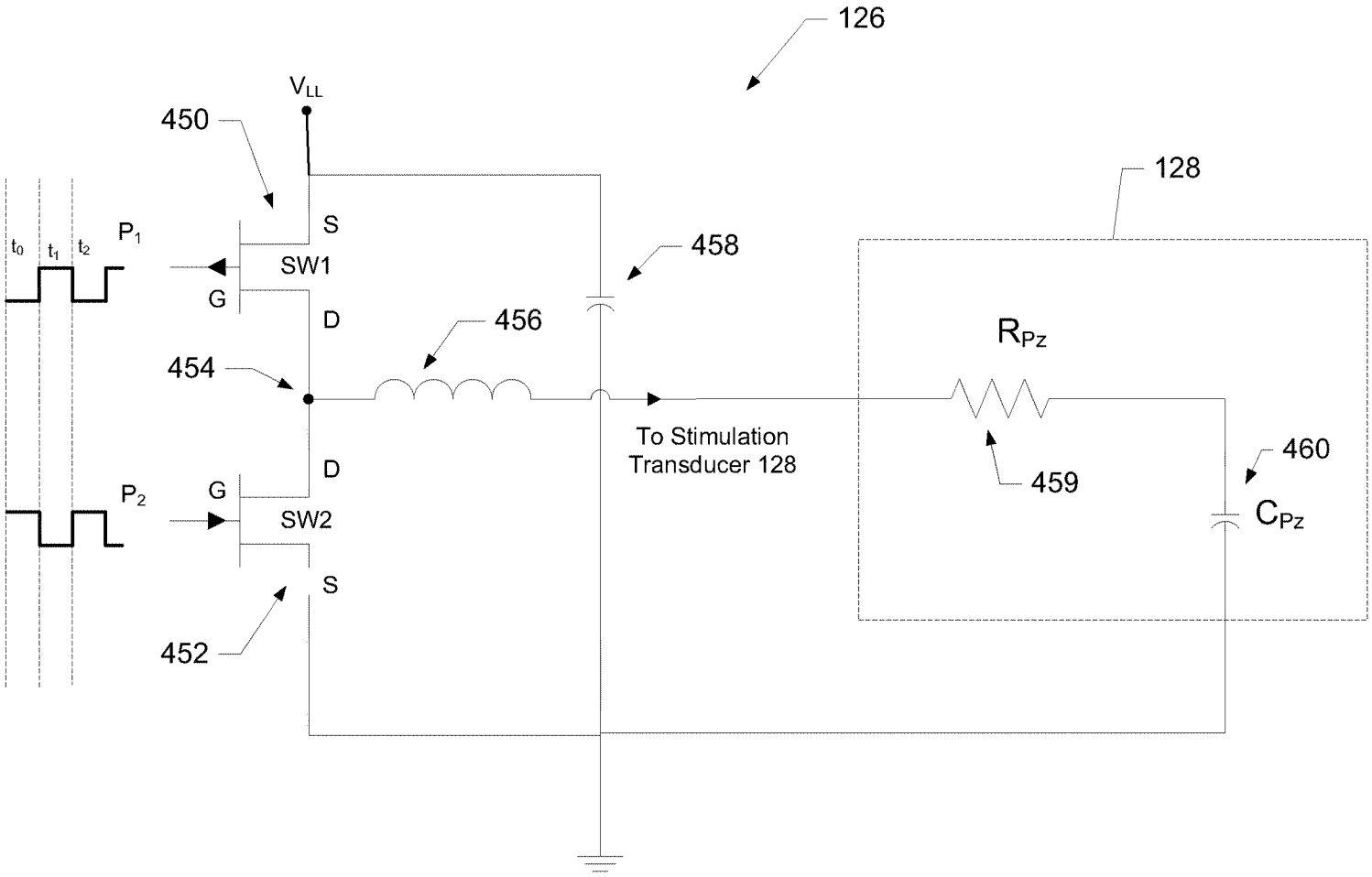
FIG. 4 is a high-level circuit diagram of an embodiment of the transducer driver circuit illustrated in FIG. 1C.

FIG. 4 illustrates an exemplary transducer driver circuit 126 of implantable module 104 of FIG. 1C.

In FIG. 4, the transducer driver circuit 126 is a Class-D circuit that includes series connected first and second switches SW1 and SW2 arranged, for example, in a half H-bridge configuration. For example, the switch SW1 can be a P-MOSFET 450 and the switch SW2 can be an N-MOSFET 452. A source of the P-MOSFET 450 is connected to the voltage $V_{LL}$. A power storage device 458, e.g., a capacitor, is connected between the voltage $V_{LL}$ and ground. A drain of the P-MOSFET 450 is connected to a drain of the N-MOSFET 452 at a node 454, and a source of the N-MOSFET 452 is connected to ground. The bit streams, $P_1$ and $P_2$, from the pulse generator 148 are provided to the gates of the P-MOSFET 450 and the N-MOSFET 452, respectively. Again, the bit streams, $P_1$ and $P_2$, are non-overlapping, which is beneficial, e.g., in that they control the P-MOSFET 450 and the N-MOSFET 452 so as to avoid cross-conduction.

The node 454 in FIG. 4 also is connected to a first end of a 'high-Q' inductor 456. In FIG. 2, the stimulation transducer 128 is modeled as a series connection of a resistor 459, $R_{Pz}$, and a capacitor 460, $C_{Pz}$. A second end of the inductor 456 is connected to a first end of a resistor 459. A second end of the resistor 459 is connected to the capacitor 460, and a second end of the capacitor 460 is connected to ground. The inductor 456 is provided to facilitate 'energy recovery' of energy that otherwise would be lost during the process of energizing the stimulation transducer 128. Again, the stimulation transducer 128 is capacitive (as illustrated by the capacitor 460), thereby making the energizing process behave similarly to that of charging the capacitor 460.

If the stimulation transducer 128 is modeled to include capacitor 460, the rate at which the transducer driver circuit 126 can charge the capacitor 460 is dq(t)=i(t)dt. At higher frequencies of the audio signal (again, provided by the audio transducer 108, and upon which the control signals fed to the transducer driver circuit 126 are based), the rate of charging the capacitor 460 correspondingly increases, which may result in commensurately higher peak currents to remove or add charge more quickly from or to the plates of the capacitor 460. Consequently, greater amounts of power are consumed in relation to higher audio frequencies.

Operational characteristics of the transducer driver circuit 126 also present opportunities to selectively smooth its power consumption, and thereby that of the implantable module 104. The P-MOSFET 450 and the N-MOSFET 452 exhibit parasitic capacitances (e.g., gate capacitances). Also, conductive paths in the ASIC exhibit parasitic capacitances. Each such capacitance is regarded as a type of power consumption generally referred to as a switching loss, $P_{SW\text{-}loss}$. Switching losses can be characterized as follows.

$$P_{SW\text{-}loss}=(C_{PD}+C_{Layout})\cdot V_{LL}^2\cdot f_{SW}\ [\text{Watts}] \qquad \text{Equation 1}$$

In Equation 1, $C_{PD}$ represents a power dissipation capacitance and is a virtual capacitance value given by the manufacturer of an ASIC. More particularly, $C_{PD}$ is a capacitance that consolidates most if not all parasitic capacitances of the switches SW1 and SW2. Also, $C_{Layout}$ represents an aggregate layout capacitance (including the capacitances of IC paths, PCB tracks, etc.). Note that $C_{Layout}$ excludes the capacitance of the stimulation transducer, $C_{Pz}$. For a Class-D amplifier, $V_{LL}$ is a supply voltage. Lastly, $f_{SW}$ represents the switching frequency.

In view of Equation 1, it can be seen that there is dependence of the switching losses upon the magnitude of the voltage $V_{LL}$, namely $P_{SW\text{-}loss}=f(V_{LL}^2)$ in some embodiments of the present invention. If the voltage $V_{LL}$ can be selectively decreased, then significant reductions in the switching losses can be achieved for such embodiments because the switching losses are proportional to the square of the voltage $V_{LL}$, namely $P_{SW\text{-}loss}=f(V_{LL}^2)$.

As noted above, in some exemplary embodiments, the level controller 168 is configured to recognize relatively quiet acoustical conditions of the recipient's environment and correspondingly adjust one or more operating parameters of the AMD 100 (e.g., bone conduction device 100C). The operating parameters that are adjusted are substantially time invariant parameters that are not used by the AMD to directly represent acoustic content of sound impinging upon the recipient. Such parameters include, for example, a voltage $V_{kk}$ used internally by the RF modulator 114, a digital modulation parameter in the circumstance that the RF modulator 114 uses digital modulation, etc. Such adjustment results in power smoothing, as will be described below.

As noted above, the RF modulator block 114 can be configured to use the OOK (On-Off Keying) type of digital modulation. A more particular example of such operating parameters is the pulse width used by the OOK modulation scheme. In an exemplary OOK modulation scheme, a binary value of one is represented by the presence of a carrier wave, i.e., the presence of pulses, during an interval representing a value of a bit (hereinafter, "bit interval"). By contrast, a binary value of zero is represented by the absence of the carrier wave, i.e., the absence of pulses, during the bit time interval. So long as the width of the pulses is sufficient to permit their recognition as pulses, the value for the width of the pulses can be varied.

Another way of viewing the width of the pulses in the OOK carrier is as a duty cycle. For a given number of pulses, greater values for the width of the pulses achieve greater duty cycles. In contrast, smaller values for the width of the pulses achieve smaller duty cycles. It is to be recalled that the rectification circuit 140 extracts power from the RF link 130, and supplies the extracted power to the RF decoder and pulse generator 122 and the transducer driver circuit 126. By selectively reducing the pulse width of the OOK carrier, the amount of power extracted by the rectification circuit 140, and therefore the value of the resultant voltage $V_{LL}$, can be selectively reduced, and so the power consumed by the transducer driver circuit 126 can be selectively reduced.

Figure 5:
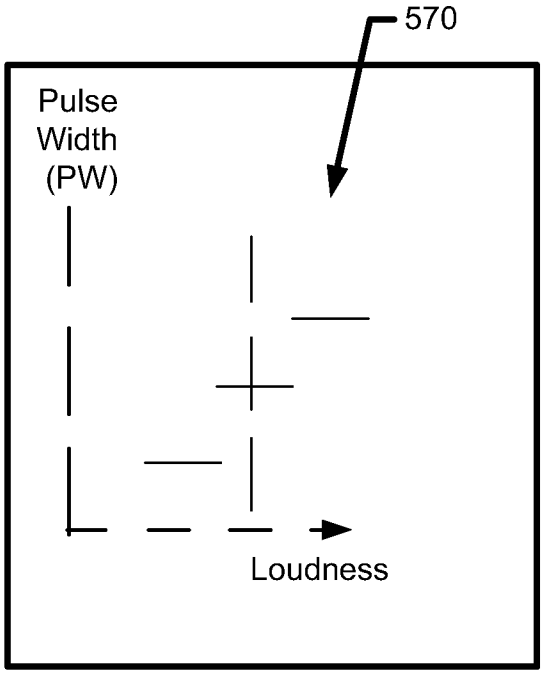
FIG. 5 is a plot of a loudness:pulse-width (PW) mapping, according to an embodiment of the present invention.

An example of a loudness:PW-mapping, according to an embodiment of the present invention, is illustrated in FIG. 5 as a plot 570 of loudness (x-axis) versus pulse width PW (y-axis). The plot 570 has a piecewise discontinuous staircase shape. Other configurations of the first mapping are contemplated. For relatively quieter conditions, the first mapping might yield the lower or middle value depicted in FIG. 5 for the pulse width PW. In contrast to the relatively quiet acoustical conditions, there will be relatively noisy conditions in which the level controller 168 either does not selectively reduce a value of the voltage $V_{LL}$ supplied to the transducer driver circuit 126, or reduces the voltage $V_{LL}$ only slightly.

Under relatively noisy conditions, the level controller 168 also may apply a default value of a gain $k_G$ that is applied to the audio signal from the audio transducer, where the default value $k_{DEF}$ is, e.g., zero gain or relatively little gain. Under the quiet conditions for which the level controller 168 selectively reduces the voltage $V_{LL}$, it may be desirable also to correspondingly increase the gain $k_G$ applied to the audio signal from the audio transducer 108.

Accordingly, the level controller 168 can be configured with a second mapping, namely a loudness:$k_G$ mapping (e.g., in the form of another look-up table (LUT), another executable block of instructions, etc.) between loudness levels and values of the gain $k_G$.

Figure 6:
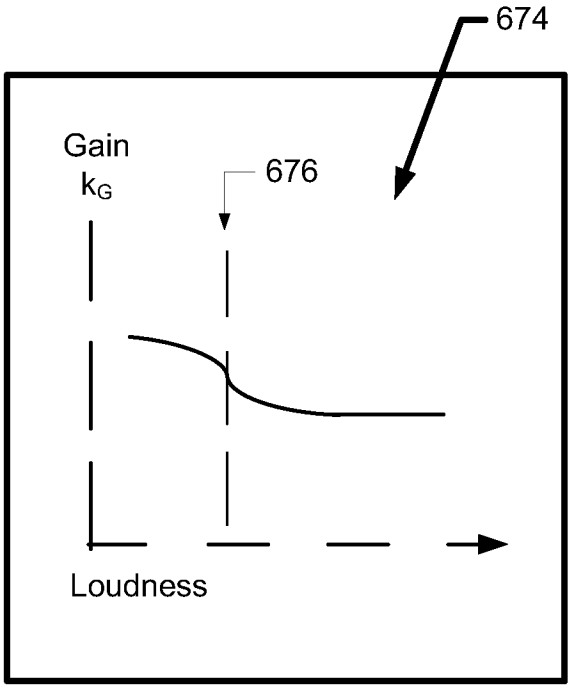
FIG. 6 is a plot of a loudness:$k_G$ mapping, according to an embodiment of the present invention.

An example of a loudness:$k_G$ mapping, according to an embodiment of the present invention, is illustrated in FIG. 6 as a plot 674 of loudness (x-axis) versus gain $k_G$ (y-axis). The plot 674 has a horizontal-S shape, and includes an inflection point 676. The value of the inflection point 676 can be set such that loudness values below the inflection point are mapped to a greater degree to increased values of the gain $k_G$, and loudness values above the inflection point are mapped to a lesser degree to increased values of the gain $k_G$ up to a loudness value at which the value of the gain $k_G$ is not further increased. The inflection point 676 can be set, for example, to coincide with an inflection point, if present, of plot 570.

Figure 7B:
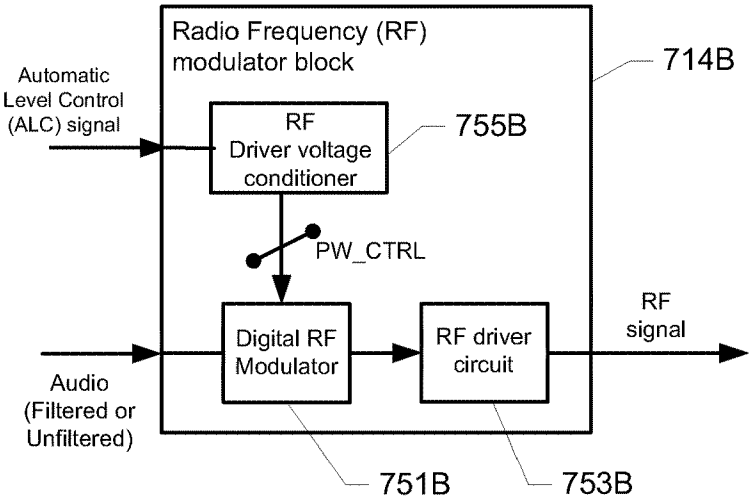
FIG. 7B illustrates an embodiment of the RF modulator illustrated in FIG. 1C, for which the adjusted operating parameter is a digital modulation parameter, namely, a pulse-width control signal (PW_CTRL)
Figure 7A:
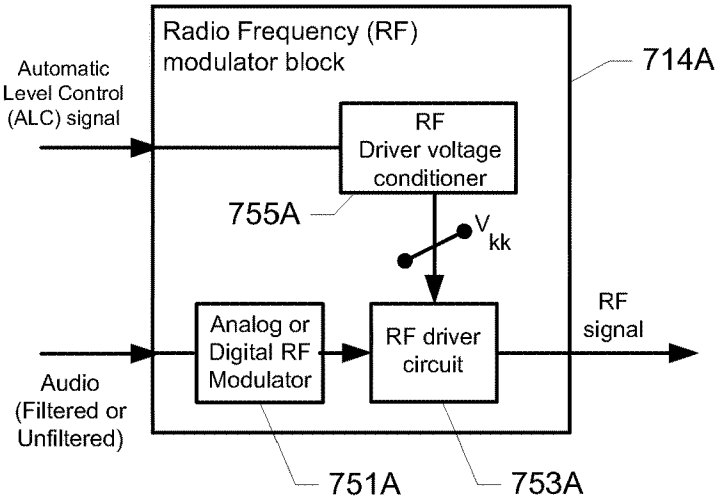
FIG. 7A illustrates an embodiment of the RF modulator illustrated in FIG. 1C, for which the adjusted operating parameter is the voltage $V_{kk}$.

FIGS. 7A and 7B illustrate exemplary embodiments of modulators 114 which react to the ALC signal output from the power-smoothing circuit 110C to adjust non-acoustic content representational operating parameters to smooth power. Specifically, FIG. 714A depicts an exemplary RF modulator usable as modulator 114 in the embodiment of FIG. 1C for which the adjusted operating parameter is the voltage $V_{kk}$. The RF modulator 714A includes an RF modulator block 751A that is either analog (e.g., amplitude modulation (AM), frequency modulation (FM), etc.) or digital (e.g., On-Off Keying (OOK) modulation, Amplitude Shift Keying (ASK) modulation, Frequency Shift Keying (FSK) modulation, Binary Phase Shift Keying (BPSK) modulation, Quadrature Phase Shift Keying (QPSK) modulation, etc.) and receives the audio signal (which can be either filtered or unfiltered). RF modulator 714A further includes an RF driver voltage conditioner 755A that provides a voltage $V_{kk}$ and an RF driver circuit 753A that is controlled by the voltage $V_{kk}$ and operates upon a modulated output from the RF modulator 751A to generate the RF signal. The ALC signal is provided as a control signal to the RF driver voltage conditioner 755A, which then adjusts the voltage $V_{kk}$ according to the ALC signal. The RF driver circuit 753A adjusts the magnitude of the RF signal according to the voltage $V_{kk}$.

FIG. 7B illustrates another example of an RF modulator 714B usable as modulator 114 in the embodiment of FIG. 1C for which the adjusted operating parameter is a digital modulation parameter (e.g., a pulse-width control signal PW_CTRL).

The RF modulator block 714B includes a digital RF modulator 751B that receives the audio signal (which can be either filtered or unfiltered), an RF driver voltage conditioner 755B that provides the pulse-width control signal PW_CTRL to the digital RF modulator 751B and an RF driver circuit 753B that operates upon a modulated output from the RF modulator 751B to generate the RF signal. The ALC signal is provided as a control signal to the RF driver voltage conditioner 755B, which then adjusts the pulse-width control signal PW_CTRL according to the ALC signal. The digital RF modulator 751B adjusts the width of the modulation pulses according to the pulse-width control signal PW_CTRL.

Figure 8:
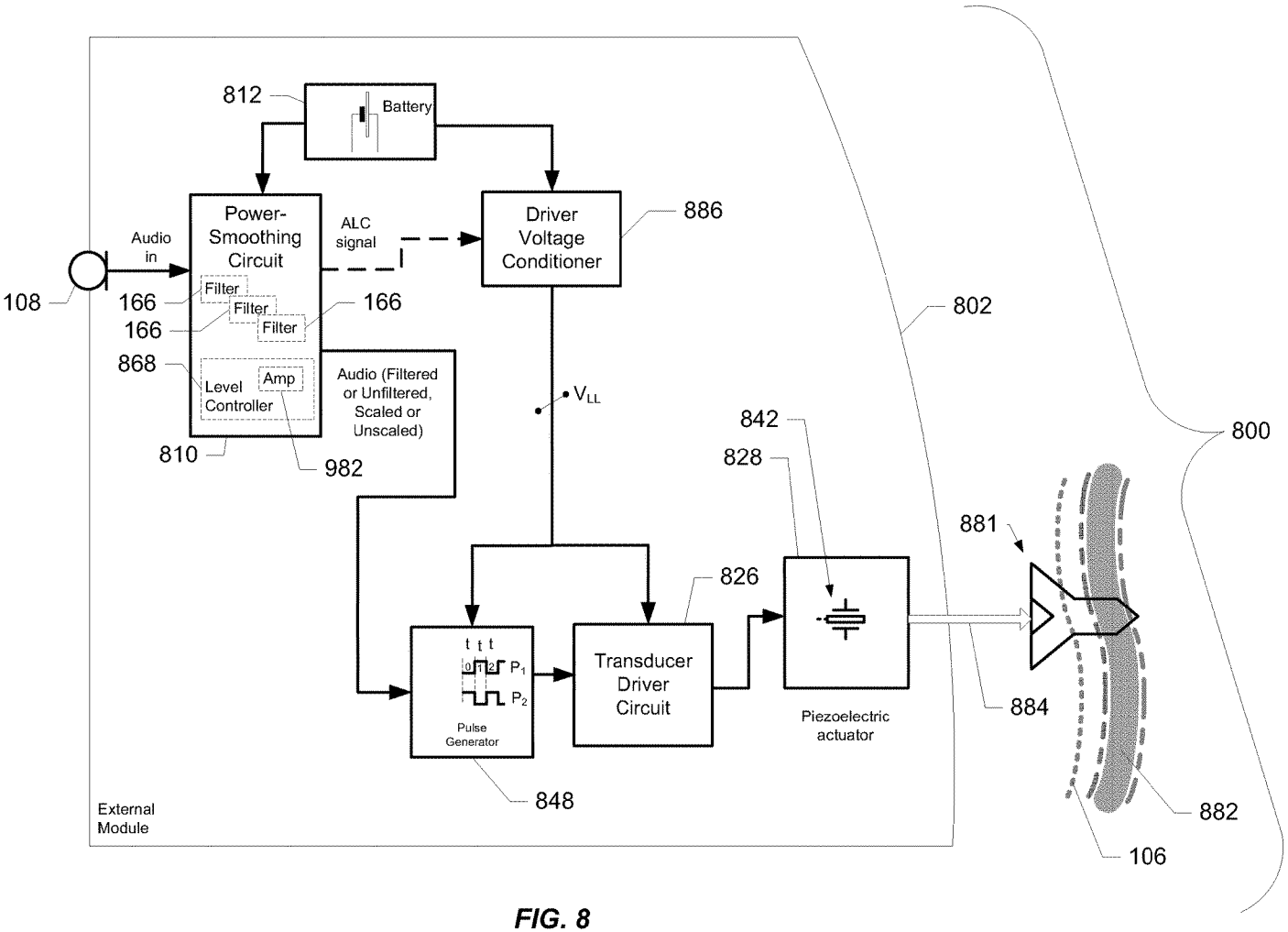
FIG. 8 is a block diagram of a bone conduction device according to another embodiment of the present invention.

As noted above, the power-smoothing features detailed herein are usable in a variety of medical devices. In this regard, embodiments have been described in terms of an active transcutaneous bone conduction device 100C with reference to FIG. 1C. In an alternate embodiment, power smoothing may be implemented in a percutaneous bone conduction device. Specifically, FIG. 8 illustrates an example of such a bone conduction device 800 having selective power-consumption-reduction. In FIG. 8, the percutaneous bone conduction device 800 includes a removable component 802 and a bone conduction implant 881 (which may comprise an abutment removably attached to a bone screw) fixed to an recipient's skull 882. The abutment extends through the skin 106 and into the skull so that a the removable component 802 can be removably coupled to implant 881 via coupling 884.

The removable component 802 of FIG. 8 includes the audio transducer 108, a power-smoothing circuit 810 that includes, for example, a digital signal processor (DSP), a power supply 812 (e.g., a battery); a driver voltage conditioner 886, a pulse generator 848, and a transducer driver circuit 826. The implantable component further includes an electromechanical stimulation transducer 828 that includes a piezoelectric actuator 842. Similar to the power smoothing circuit 110F of FIG. 1F, the power smoothing circuit 810 includes one or more filters 166, and/or a level controller 868 (which is similar to the level controller 168). If present, the one or more filters 166 provide a filtered audio signal(s) to the pulse generator 848, else the power smoothing circuit 810 simply transfers an unfiltered audio signal(s) to the pulse generator 848. If present, the level controller 168 provides an automatic level control (ALC) signal to the driver voltage conditioner 886. As there are several possible combinations, the one or more filters 166, the level controller 868 and the ALC signal are illustrated using phantom lines.

In operation, the voltage conditioner 886 generates a voltage $V_{LL}$ that is provided to the pulse generator 848 and the transducer driver circuit 826. Similarly, the stimulation transducer 828 can be regarded as a capacitive load to the transducer driver circuit 826.

As with pulse generator 148, the pulse generator 848 can be a pulse width modulator, pulse density modulator or a sigma-delta modulator. The pulse generator 848 produces two bit streams, $P_1$ and $P_2$, with each bit stream being 1-bit wide. It is to be observed that the bit streams $P_1$ and $P_2$ are non-overlapping. The transducer driver circuit 826, for example, can be driven directly with the two bit streams, $P_1$ and $P_2$. A simple OOK envelope detector can be made, e.g., using a diode loaded to an RC parallel circuit.

Similarly to the one or more operating parameters discussed above, operating parameters of the bone conduction device 800 include, for example, a level of the voltage $V_{LL}$ provided to the transducer driver circuit 826. Again, such parameters are parameters are substantially time invariant and not used by the AMD to directly represent acoustic content of sound impinging upon the recipient, Accordingly, like the level controller 168, not only is the level controller 868 operable to recognize relatively quiet acoustical conditions, but it is further operable to then adjust (by selectively reducing) a level of the voltage $V_{LL}$ provided to the transducer driver circuit 826.

More particularly, the level controller 868 is operable to determine a loudness value based upon the audio signal from the audio transducer 108. The level controller 868 is configured with a third mapping, namely a loudness:$V_{LL}$ mapping (e.g., in the form of a look-up table, an executable block of instructions, etc.) between loudness levels and levels of the voltage $V_{LL}$. The level controller 868 is further operable to index the loudness level into the third mapping and retrieve therefrom a corresponding value of the voltage $V_{LL}$.

Figure 10:
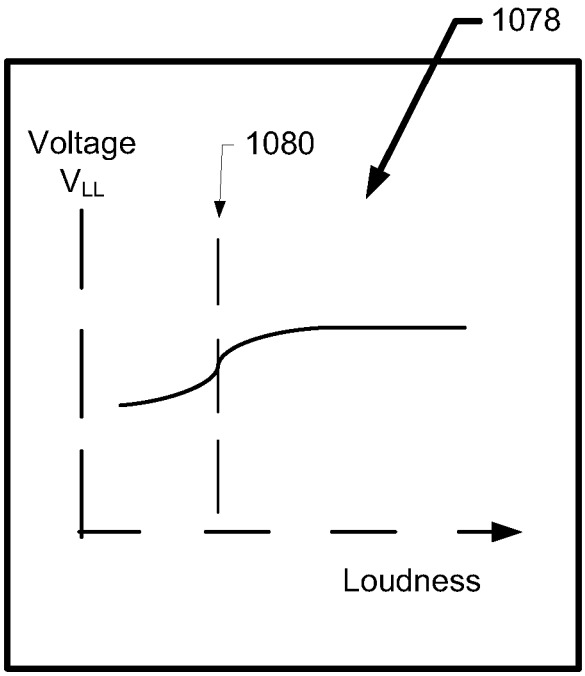
FIG. 10 is a plot of a loudness:voltage $V_{LL}$ mapping according to an embodiment of the present invention.

An example of a loudness:$V_{LL}$-mapping, according to an embodiment of the present invention, is illustrated in FIG. 10 as a plot 1078 of loudness (x-axis) versus voltage $V_{LL}$ (y-axis). The plot 1078 has a horizontal-S shape, and includes an inflection point 1080. The value of the inflection point 1080 may be set such that loudness values below the inflection point are mapped to a greater degree to reduced values of the voltage $V_{LL}$, and loudness values above the inflection point are mapped to a lesser degree to reduced values of the voltage $V_{LL}$, up to a loudness value at which the value of the voltage $V_{LL}$ is not further reduced. Some typical loudness values (in dB SPL) are: 20 dB for background noise in a television studio; 30 dB for a quiet bedroom at night; and 40 dB for a quiet library. The inflection point 1078 of the loudness:$V_{LL}$ plot could be set, e.g., in the range of about 20 dB to about 40 dB. Other configurations of the third mapping are contemplated.

As with level controller 168, the level controller 868 is similarly operable, under the quiet conditions for which the level controller 868 selectively reduces the voltage $V_{LL}$, also to optionally and correspondingly increase the gain $k_G$ applied to the audio signal from the audio transducer 108.

Accordingly, the level controller 868 can be configured with the second mapping, similarly to the level controller 168.

Various aspects of the present invention provide advantages over the Background Art. For example, the arrangement shown allows much of the circuit complexity to remain in the external module 102 with a simplified arrangement of the implantable module 104.

The arrangements described herein may be used in a uni-directional system (i.e. power and data flow from the external module to the implantable module), thus allowing for further simplification of the implantable module. The various aspects of the present invention have been described with reference to specific embodiments. It will be appreciated however, that various variations and modifications may be made within the broadest scope of the principles described herein.

Figure 9A:
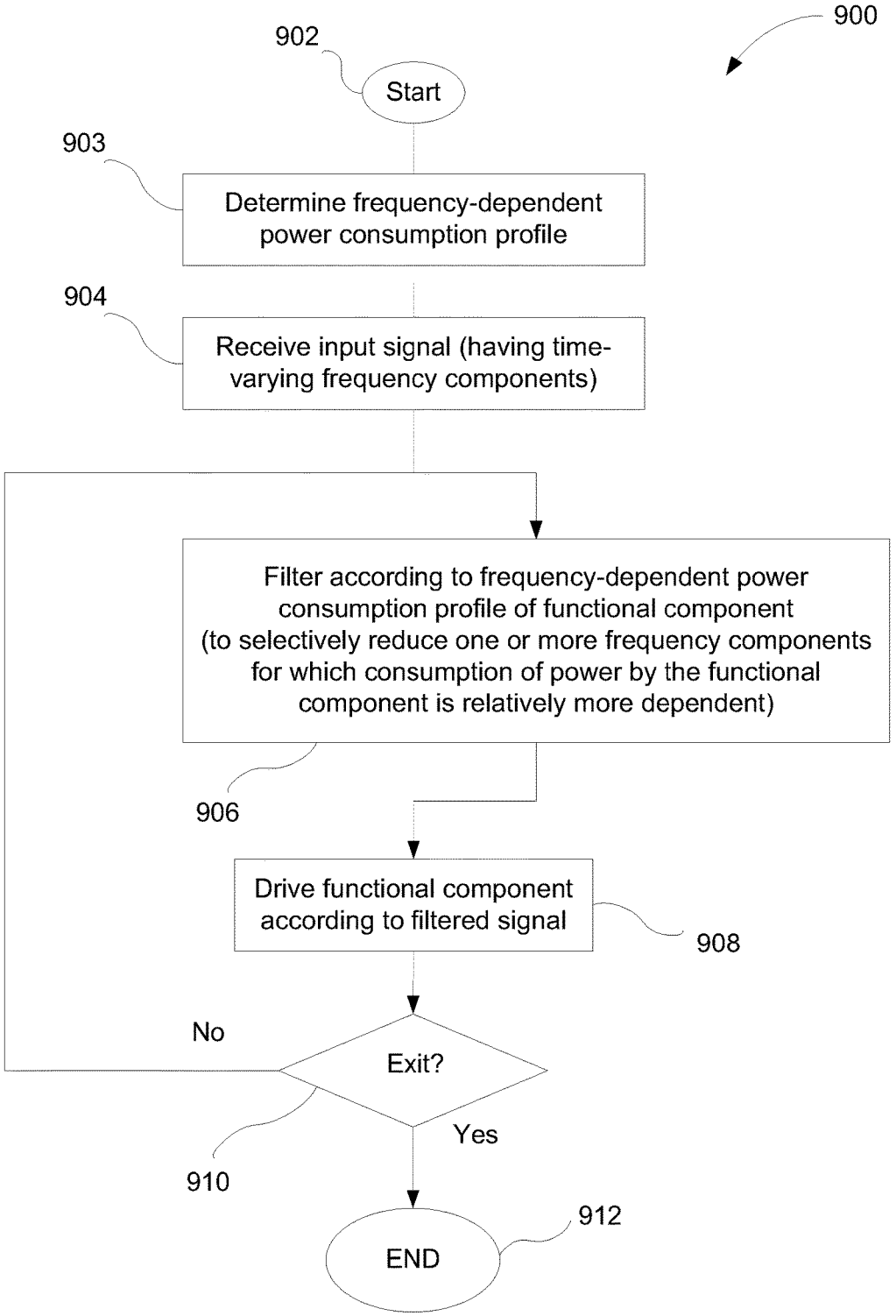
FIG. 9A is a flowchart of an embodiment of a method of smoothing power consumption of an active medical device.

Some embodiments include methods of manufacturing and/or calibrating the AMD of FIG. 1A. In this regard, FIG. 9A is a flowchart, according to an embodiment of the present invention, of an exemplary method 900 entailing smoothing power consumption of an AMD, e.g., 100A. In this embodiment, the AMD includes a functional component that has a frequency-dependent power consumption profile. Specifically, in FIG. 9A, the method starts at block 902 and proceeds to block 903, where the frequency-dependent power consumption profile for the functional component is determined. It is noted that profile determination can take place before (as mentioned above), during or after implantation. An exemplary embodiment includes methods by which profiles (e.g., frequency-dependent power consumption (FDPC) profiles) may be determined during or after implementation. For example, in an embodiment where the AMD is a hearing prosthesis (e.g., a middle-ear implant), the frequency-dependent power consumption profile can be determined during implantation, during the post-implantation fitting process, or thereafter. An exemplary embodiment utilizes the post-implantation determination of an FDPC described in U.S. patent application Ser. No. 13/106,335, filed May 12, 2011. As such, a delay between block 903 and a subsequent block 904 is variable depending upon the particular manner by which block 903 is implemented. From block 903, flow proceeds to block 904.

At block 904, an input signal having time-varying frequency components (e.g., an audio signal) is received. From block 904, the method proceeds to block 906, which entails the step of filtering the input signal.

More particularly, at block 906, the input signal is filtered according to the power consumption profile so as to selectively reduce one or more frequency components for which consumption of power by the functional component is relatively more dependent (i.e., one or more of the relatively more power intensive frequency components in the input signal). From block 906, the method proceeds to block 908, which entails the step of driving the functional component according to the filtered signal. From block 908, the method proceeds to block 910, which entails determining whether exit conditions have been satisfied (e.g., whether sufficient frequency component reduction has occurred to obtain desired power consumption reduction). If not, the method proceeds from block 910 back to block 906. If exit conditions have been satisfied, the method proceeds from block 910 to block 912, where the method ends.

It is further noted that this method may be practiced during normal use of the AMD. For example, the magnitude of the frequency reduction may be varied during normal use to further reduce power consumption. Such may be the case in the event of a batter with a very low charge, thus prolonging operation of the AMD for an additional period of time, however brief.

An exemplary embodiment includes a method executed by the AMD 100B of FIG. 1B. Specifically, FIG. 9B presents a flowchart according to an embodiment of the present invention representing an exemplary method 920 of smoothing power consumption of AMD 100B.

Figure 9B:
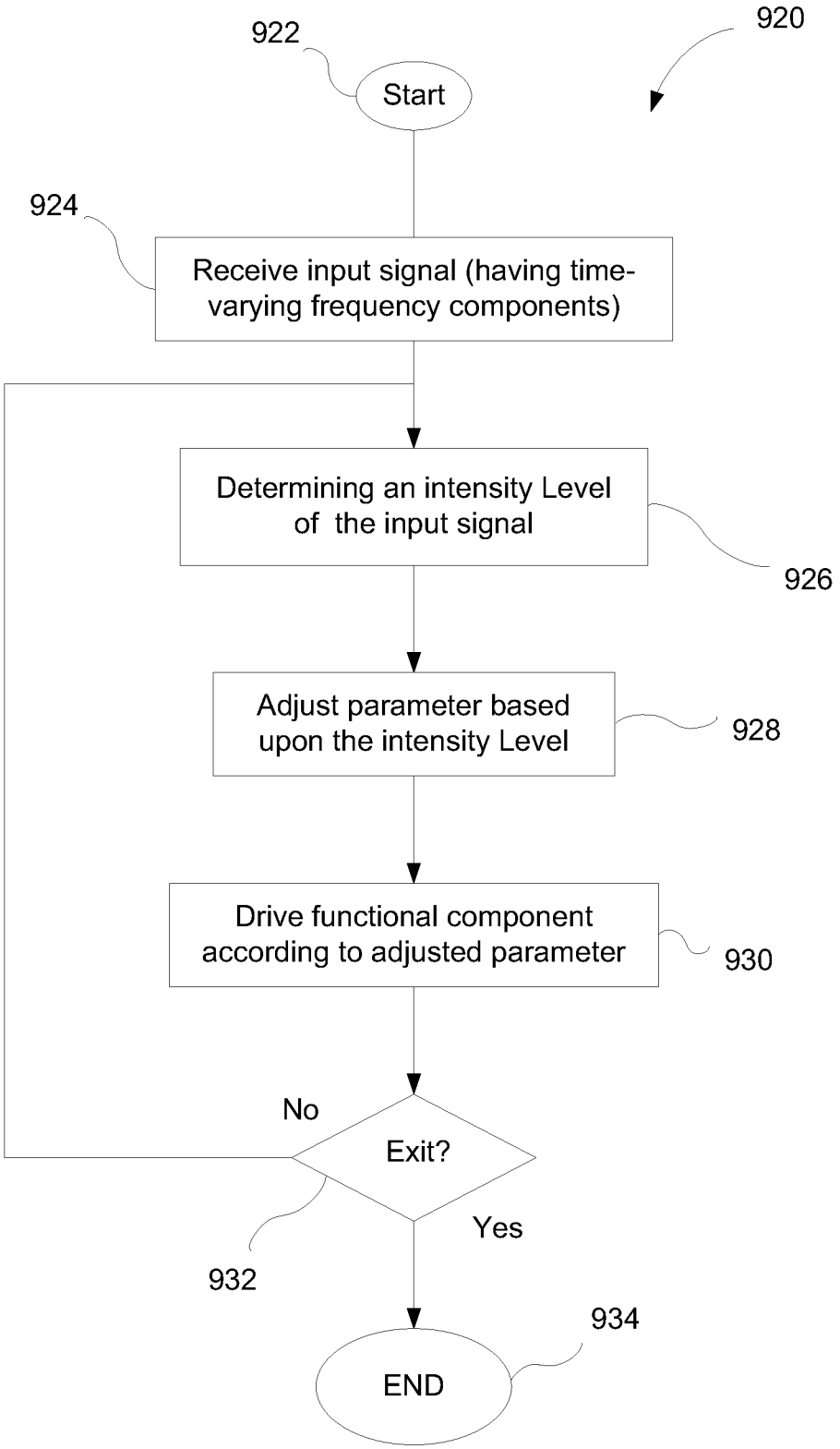
FIG. 9B is a flowchart of an example method of smoothing power consumption of an AMD according to an embodiment of the present invention.

In FIG. 9B, the method starts at block 922 and proceeds to block 924, where an input signal having time-varying frequency components (e.g., an audio signal), is received. From block 924, the method proceeds to block 926, where an intensity level (e.g., a loudness level), of the input signal is determined. The method then proceeds from block 926 to block 928, where a parameter (e.g., pulse-width control signal, PW_CTRL as mentioned above) of the AMD, is adjusted based upon the loudness level of the input signal. The method then proceeds from block 928 to block 930, where the functional component is driven according to the adjusted parameter. From block 930, the method proceeds to block 932, where a determination is made whether exit conditions have been satisfied (e.g., whether the parameter has been sufficiently adjusted to obtain sufficient/desired power consumption reduction). If exit conditions have not been satisfied, the method proceeds from block 932 and loops back up to block 926. If exit conditions have been satisfied, the method proceeds from block 932 to block 934, where the method ends.

It is noted that the just-described method may be practiced before or after implantation of the AMD. Its further noted that implantation includes attachment of an external component to the recipient that does not penetrate the skin.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

Reference herein to "one embodiment" or "an embodiment" means that a particular feature, structure, operation, or other characteristic described in connection with the embodiment may be included in at least one implementation of the present invention. However, the appearance of the phrase "in one embodiment" or "in an embodiment" in various places in the specification does not necessarily refer to the same embodiment. It is further envisioned that a skilled person could use any or all of the above embodiments in any compatible combination or permutation.

It is to be understood that the detailed description and specific examples, while indicating embodiments of the present invention, are given by way of illustration and not limitation. Many changes and modifications within the scope of the present invention may be made without departing from the spirit thereof, and the present invention includes all such modifications.

What is claimed is:

1. An active medical device, comprising:

an input receiver configured to receive a frequency-varying input signal; and a functional component that reacts to the input signal and consumes power at a rate dependent on a frequency of the input signal to which the functional component reacts, wherein the device is configured to alter a performance of the functional component, relative to that which would be the case in the absence of the alteration, based on the frequency of the input signal, thereby reducing power consumption of the medical device relative to that which would otherwise be the case, the rate generally increases with the frequency of the input signal, and the active medical device includes a low-pass filter configured to perform the adjustment by filtering frequencies above a give frequency, wherein the frequencies above the given frequency comprise the one or more portions of the input signal.

2. The active medical device of claim 1, wherein:
the device is configured to make a performance adjustment based on portions of the input signal that would otherwise cause the functional component to consume power at a rate that is greater than that of other portions of the input signal, all other things being equal.

3. The active medical device of claim 1, wherein:
the device is configured to make an adjustment of one or more portions of the input signal where the functional component consumes power at a rate that is greater than that of other portions of the input signal.

4. The active medical device of claim 1, wherein:
the active medical device includes a power-smoothing circuit configured to perform the adjustment.

5. The active medical device of claim 4, wherein:
the power-smoothing circuit includes the low-pass filter.

6. The active medical device of claim 1, wherein:
the filter is a notch filter.

7. The active medical device of claim 1, wherein:
the active medical device is a bone conduction device; and
the functional component is a vibrator.

8. The active medical device of claim 7, wherein:
the bone conduction device is an active transcutaneous bone conduction device.

9. The active medical device of claim 1, wherein:
the rate generally increases with the frequency of the input signal; and
the active medical device includes a low-pass filter configured to perform the adjustment by filtering frequencies above a give frequency, wherein the frequencies above the given frequency comprise the one or more portions of the input signal.

10. An active medical device comprising:
a functional component that has a parameter-dependent power consumption profile; and
a circuit configured to determine a first parameter of an input signal, and to adjust, based on the first parameter, a second parameter referenced by the functional component upon which the parameter-dependent power consumption profile depends so as to selectively reduce power consumption of the functional component, wherein the functional component is operably responsive to the adjusted second parameter, wherein
the active medical device includes an external component and an implantable component,
the active medical device includes a wireless transmission system configure such that the external component is in wireless communication with the external component, and
the second parameter is a duty cycle of the wireless transmission system.

11. The active medical device of claim 10, wherein:
the first parameter is an intensity level of a frequency-varying input; and
the circuit is configured to determine an intensity level of the frequency-varying input signal, and to adjust, based on the intensity level, the second parameter.

12. The active medical device of claim 10, wherein:
the second parameter is a substantially time-invariant parameter.

13. The active medical device of claim 10, wherein:
the functional component is a transducer configured to vibrate in response to the received input signal;
the transducer is energized based on a voltage $V_{LL}$; the second parameter is the voltage $V_{LL}$; and
the circuit is operable to selectively decrease the voltage $V_{LL}$ based upon the first parameter.

14. The active medical device of claim 10, wherein:
the active medical device is a cochlear implant; and
the first parameter is indicative of an environment in which the cochlear implant is in corresponding to a relatively quiet environment.

15. A method of reducing power consumption of an active medical device including a functional component reactive to an input signal, comprising:
(i) receiving the input signal;
(ii) at least one of managing the input signal or evaluating the input signal; and
(iii) controlling the functional component based on action "ii" such that the functional component reacts to the provided at least one signal in a manner that consumes less power than that which would otherwise be the case in the absence of the management of the input signal, wherein
action "ii" includes filtering the input signal to attenuate frequencies for which the functional component consumes power at a rate that is greater than that of other frequencies.

16. The method of claim 15, wherein:
the input signal is representative of an acoustic signal, and
action "iii" evokes a hearing percept.

17. The method of claim 15, wherein action "ii" includes:
filtering out a band of frequencies at which a rate of power consumption of the functional component is at least about twice that of frequencies below and above the band of frequencies.

18. The method of claim 15, further comprising:
determining a frequency-dependent power consumption profile of the functional component during or subsequent to an implantation of the functional component in a recipient, wherein action "ii" is based upon the frequency-dependent power consumption profile.

19. The active medical device of claim 1, wherein:
the frequency of the input signal upon which the performance alteration is based is a power hungry frequency relative to other frequencies, all other things being equal.

20. The method of claim 15, wherein:
further comprising, separate from action "iii," adjusting a gain of the active medical device based on ambient conditions.

21. The method of claim 15, wherein:
further comprising, separate from action "iii," adjusting a gain of the active medical device based on noise conditions.

22. The active medical device of claim 1, wherein:
the device is configured to alter the performance of the functional component, relative to that which would be the case in the absence of the alteration, based on the frequency of the input signal, irrespective of ambient conditions.

23. The method of claim 15, wherein:
action "ii" includes attenuating frequencies of the input signal for which the functional component consumes power at a rate that is greater than that of other frequencies and not attenuating the other frequencies.

24. The method of claim 15, further comprising:
separate from the action of "iii," in an environment with background noise, adjusting controlling the functional component based on loudness values of the received input signal such that the functional component reacts to the provided at least one signal in a manner that results in a perceived loudness that is not as loud as that which would be the case in the absence of the adjustment based on loudness values.

25. The active medical device of claim 1, wherein:

the functional component is an implantable functional component implanted in a recipient.

26. The active medical device of claim 1, wherein:

the functional component is a component that evokes a hearing percept based on a signal based on sound;

in the absence of the alteration of the performance of the functional component, the functional component consumes power as a function of frequency of the sound that sharply increases and sharply decreases within a narrow frequency band relative to frequencies above and below the sharp decrease and sharp increase, respectively.

* * * * *